US008292669B2

(12) United States Patent
Wang et al.

(10) Patent No.: US 8,292,669 B2
(45) Date of Patent: Oct. 23, 2012

(54) ELECTRICAL CONNECTOR HAVING CONTACT MODULES

(75) Inventors: Chien-Chiung Wang, New Taipei (TW); Qing-Man Zhu, Kunshan (CN); Xue-Liang Zhang, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/206,738

(22) Filed: Aug. 10, 2011

(65) Prior Publication Data

US 2012/0040563 A1 Feb. 16, 2012

(51) Int. Cl.
*H01R 24/00* (2006.01)

(52) U.S. Cl. ..... 439/637; 439/607.2

(58) Field of Classification Search ..... 439/637, 439/60, 701, 924.1, 607.2
See application file for complete search history.

(56) References Cited

U.S. PATENT DOCUMENTS 5,425,651 A * 6/1995 Thrush et al. ..... 439/326
6,142,802 A 11/2000 Berg et al.
6,203,328 B1 * 3/2001 Ortega et al. ..... 439/60
7,198,519 B2 * 4/2007 Regnier et al. ..... 439/637
7,833,068 B2 * 11/2010 Bright et al. ..... 439/733.1
2004/0072467 A1 * 4/2004 Jordan et al. ..... 439/492
2006/0009080 A1 * 1/2006 Regnier et al. ..... 439/637
2006/0014438 A1 * 1/2006 Regnier ..... 439/637
2007/0232091 A1 10/2007 Hong
2010/0233910 A1 * 9/2010 Zhang et al. ..... 439/626

* cited by examiner

*Primary Examiner* — Edwin A. Leon
*Assistant Examiner* — Harshad Patel
(74) *Attorney, Agent, or Firm* — Ming Chieh Chang; Wei Te Chung

(57) ABSTRACT

An electrical connector (100) adapted for being mounted on a mother board (900) includes a housing and a number of contact modules (21, 22) each having a wafer (210, 220) and a number of terminals insert molded with the wafer. The terminals include an upper terminal (211, 221) having an upper contact portion (2111, 2211), and a lower contact terminal (212, 222) having a lower contact portion (2121, 2221). The upper contact portion and the lower contact portion are separated from each other along a vertical direction to define a slot (214, 224) therebetween. The upper terminal and the lower contact terminal are secured in the wafer at two positions remote from each other along a mating direction perpendicular to the vertical direction, with the upper contact portion and the lower contact portion approaching close to each other along the mating direction.

18 Claims, 11 Drawing Sheets

ELECTRICAL CONNECTOR HAVING CONTACT MODULES

BACKGROUND OF THE INVENTION

1. Field of the Invention

The present invention relates to an electrical connector, and more particularly to a SFP (Small Form-Factor Pluggable) connector adapted for mating with a mating connector having a paddle board and mounted on a mother board.

2. Description of Related Art

U.S. Pat. No. 6,142,802 issued to Berg et al. on Nov. 7, 2000 discloses an SFP transceiver connector mating with a plug connector having a paddle board. The transceiver connector includes a housing defining a plurality of passageways, a plurality of first terminals and second terminals mounted in passageways of the housing. The paddle board is formed with a plurality of first pads and second pads. When the plug connector is inserted into the transceiver connector, the first terminals come to contact with the first pads for transmitting differential signal, power signal and grounding signal. The second terminals come to contact with the second pads for transmitting power signal and grounding signal.

The first and second terminals may not be stitched in the housing with a desired precision.

Hence, an electrical connector having a contact module is desired.

SUMMARY OF THE INVENTION

Accordingly, an object of the present invention is to provide an electrical connector including a contact module having terminals insert molded in a wafer to fix the terminals reliably.

In order to achieve the object set forth, an electrical connector adapted for being mounted on a mother board includes a housing and a plurality of contact modules secured to the housing. Each contact module has a wafer and a plurality of terminals insert molded with the wafer. The terminals include an upper terminal having an upper contact portion, and a lower contact terminal having a lower contact portion. The upper contact portion and the lower contact portion are separated from each other along a vertical direction to define a slot therebetween. The upper terminal and the lower contact terminal are secured in the wafer at two positions remote from each other along a mating direction perpendicular to the vertical direction, with the upper contact portion and the lower contact portion approaching close to each other along the mating direction.

The upper terminal and the lower contact terminal are insert molded with the wafer to thereby be secured at predetermined positions stably. The upper contact portion and the lower contact portion extend toward each other to make the upper and lower contact portions in contact with the conducive pads of a paddle board of a mating connector reliably.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
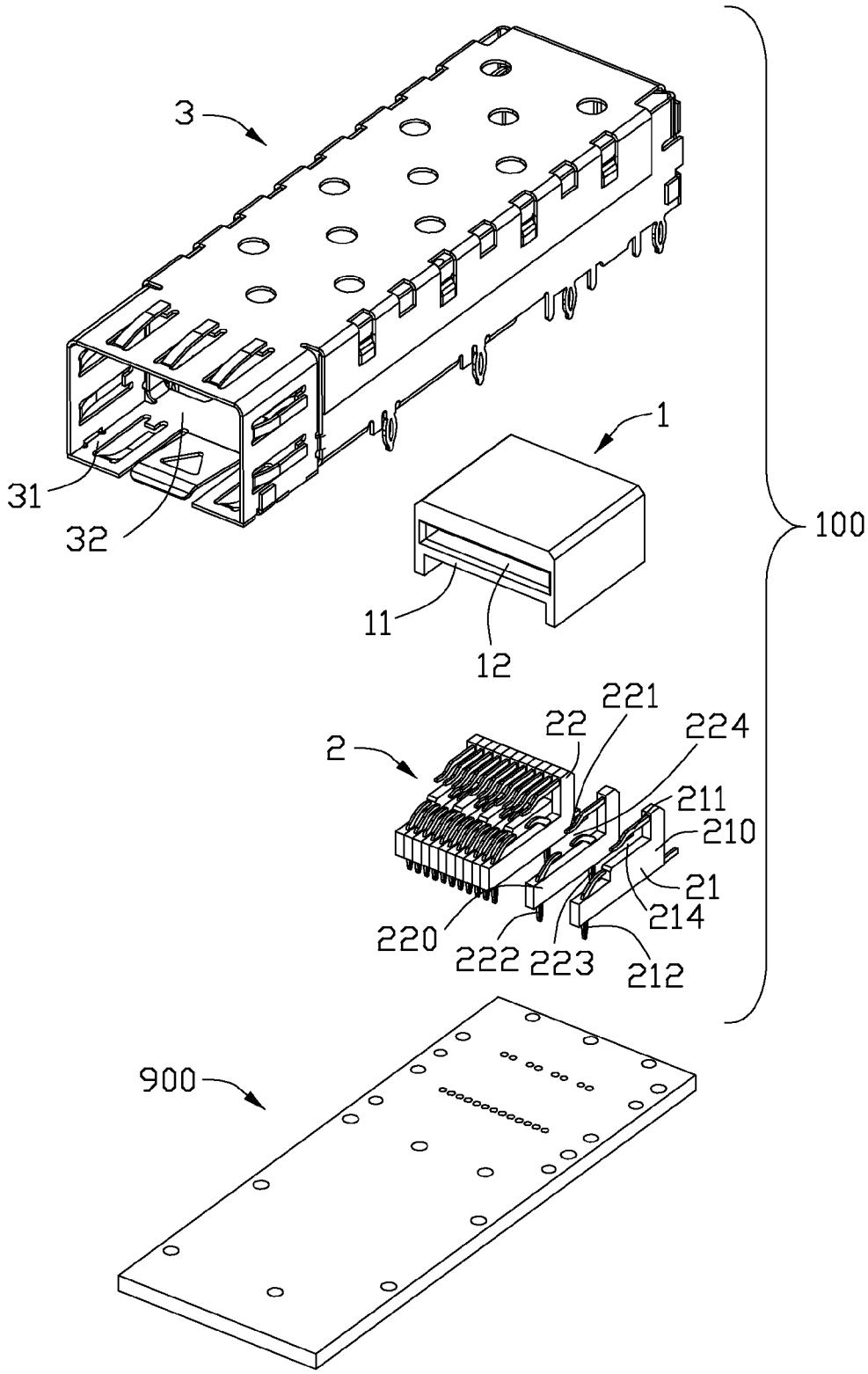
FIG. 1 is an exploded view showing an electrical connector and a mother board in accordance with a first embodiment of the present invention.
Figure 5:
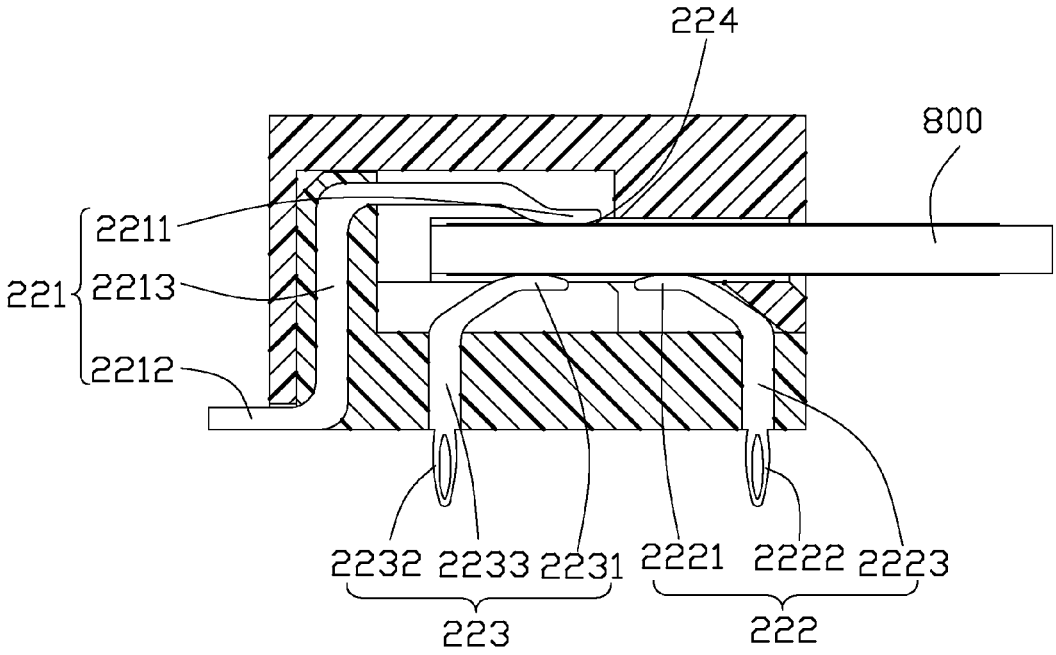
FIG. 5 is a cross-sectional view showing the second contact module in contact with the paddle board, taken along line 5-5 of FIG. 3, with a second wafer omitted.

Referring to FIGS. 1 and 5, an electrical connector 100 in accordance with a first embodiment of the present inversion is adapted for mating with a mating connector (not shown) having a paddle board 800. The paddle board 800 is insertable in the electrical connector 100.

Figure 2:
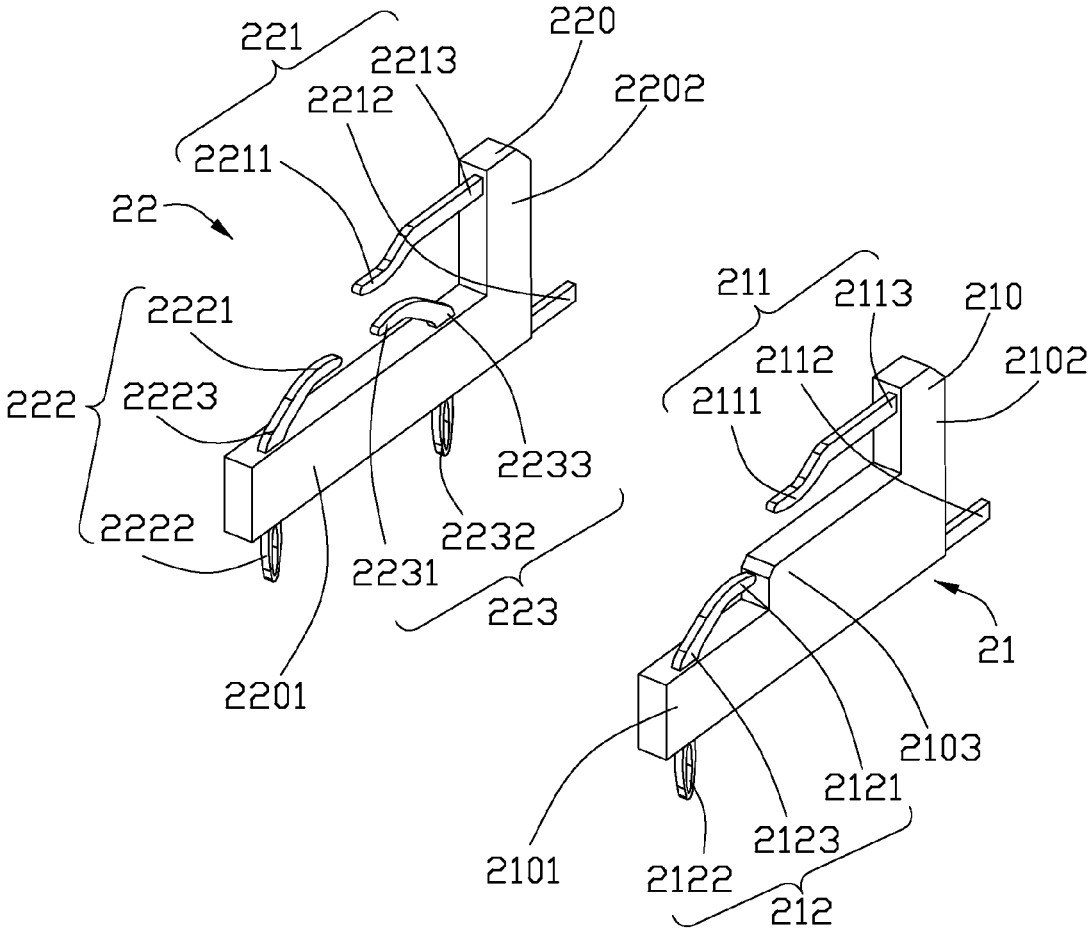
FIG. 2 is a perspective view showing a first and a second contact modules as shown in FIG. 1.
Figure 3:
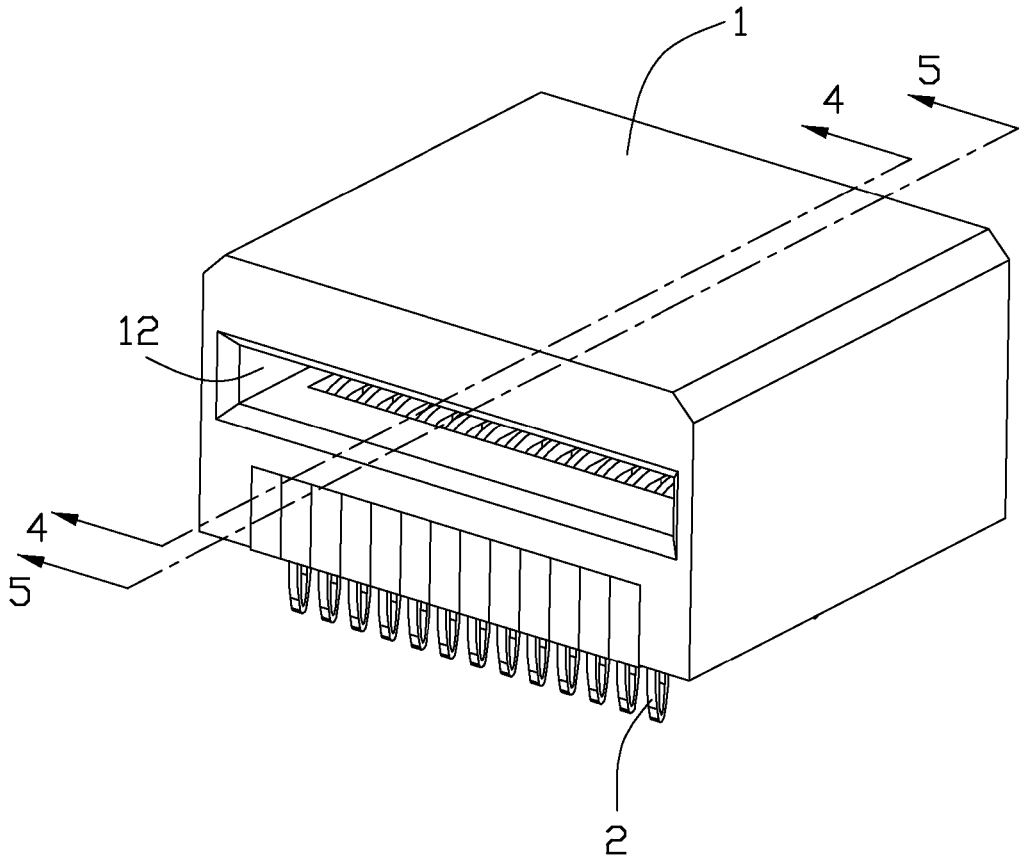
FIG. 3 is a perspective view showing contact modules mounted in a housing shown in FIG. 1.

Referring to FIGS. 1 to 3, the electrical connector 100 comprises a housing 1, a plurality of contact modules 2 secured in the housing 1, and a shielding shell 3 attached to the housing 1.

Referring to FIG. 1, the housing 1 has a bar 11 and an inserting opening 12 above the bar 11.

Referring to FIGS. 1-4, the plurality of contact modules 2 comprise a plurality of first contact modules 21 and a plurality of second contact modules 22. Each first contact module 21 includes a first wafer 210 made from insulative material, a first upper terminal 211 and a first lower contact terminal 212. The first upper terminal 211 and the first lower contact terminal 212 are insert molded in the first wafer 210.

The first wafer 210 includes a horizontally extending first base portion 2101, a stepped portion 2103, and a longitudinally extending first supporting portion 2102.

The first upper terminal 211 includes a first upper contact portion 2111, a first upper mounting portion 2112, and a first upper connecting portion 2113 connecting with the first upper contact portion 2111 and the first upper mounting portion 2112 and secured in the first supporting portion 2102 along a substantial mating direction.

The first lower contact terminal 212 includes a first lower contact portion 2121, a first lower mounting portion 2122, and a first lower connecting portion 2123 connecting with the first lower contact portion 2121 and the first lower mounting portion 2122 and secured in the first base portion 2101 along substantial vertical direction. The first upper terminal 211 and the first lower contact terminal 212 are secured in the first wafer 210 at two secured positions remote from each other along the mating direction.

Figure 4:
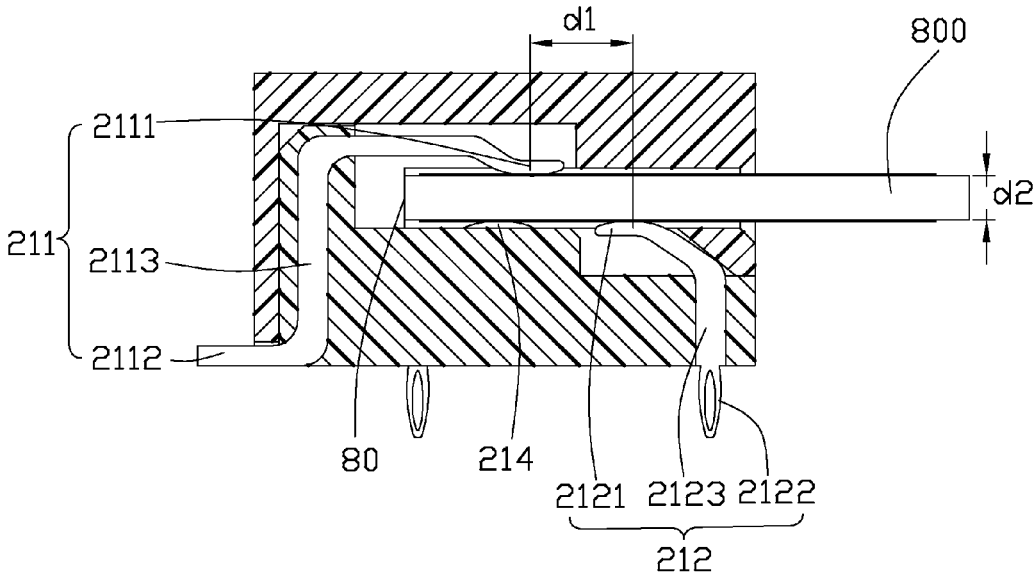
FIG. 4 is a cross-sectional view showing the first contact module in contact with a paddle board, taken along line 4-4 of FIG. 3, with a first wafer omitted.

The first upper contact portion 2111 and the first lower contact portion 2121 have a first slot 214 defined therebetween. The first upper contact portion 2111 is disposed substantially horizontally above the first slot 214, and the first lower contact portion 2121 is bent to extend generally horizontally below the first slot 214. The stepped portion 2103 is disposed below the first slot 214 and faces to the first upper contact portion 2111 of the first upper terminal 211. The first lower contact portion 2121 of the first lower contact terminal 212 have an upper surface substantially flush with the stepped portion 2103. The first upper contact portion 2111 and the first lower contact portion 2121 approach close to each other along the mating direction. The first upper contact portion 2111 and the first lower contact portion 2121 are separated from each other a first distance d1 along the mating direction and separated from each other a second distance d2 along the vertical direction, as shown in FIG. 4.

Each second contact module 22 includes a second wafer 220 made from insulative material, a second upper terminal 221, a second lower contact terminal 222, and a second lower conductive terminal 223. The second upper terminal 221, the second lower contact terminal 222, and the second lower conductive terminal 223 are insert molded in the second wafer 220.

The second wafer 220 includes a horizontally extending second base portion 2201, and a longitudinally extending second supporting portion 2202.

The second upper terminal 221 includes a second upper contact portion 2211, a second upper mounting portion 2212, and a second upper connecting portion 2213 connecting with the second upper contact portion 2211 and the second upper mounting portion 2212 and secured in the second supporting portion 2202 along substantial horizontal direction.

The second lower contact terminal 222 includes a second lower contact portion 2221, a second lower mounting portion 2222, and a second lower connecting portion 2223 connecting with the second lower contact portion 2221 and the second lower mounting portion 2222 and secured in the second base portion 2201 along substantial vertical direction. The second upper terminal 221 and the second lower contact terminal 222 are secured in the second wafer 220 at two secured positions remote from each other along the mating direction. The second lower conductive terminal 223 are secured in the second wafer 220 at another secured position between the above two secured positions along the mating direction.

The second lower contact portion 2231 of the second lower conductive terminal 223 is arranged in mirrored image with the second lower contact portion 2221 of the second lower contact terminal 222. The second lower conductive terminal 223 includes a second lower contact portion 2231, a second lower mounting portion 2232, and a second lower connecting portion 2233 connecting with the second lower contact portion 2231 and the second lower mounting portion 2232 and secured in the second base portion 2201 along substantial vertical direction.

The second upper contact portion 2211 of the second upper terminal 221 and the second lower contact portion 2231 of the second lower conductive terminal 223 have a second slot 224 defined therebetween. The second upper contact portion 2211 is disposed substantially horizontally above the second slot 214, and the second lower contact portions 2221, 2231 are bent to extend generally horizontally below the second slot 224. The second upper contact portion 2211 and the second lower contact portion 2231 extend forwardly. The second lower contact portion 2221 of the second lower contact terminal 222 and the second lower contact portion 2231 of the second lower conductive terminal 223 approach close to each other and have upper surfaces flush with each other. The second upper contact portion 2211 and the second lower contact portion 2231 are separated from each other the second distance d2 along the vertical direction. The second lower contact terminal 222 is disposed more adjacent to the inserting opening 12, compared to the second lower conductive terminal 223.

The shielding shell 3 has a mating opening 31 in front of the shielding shell 3 and a mounting opening 33 at a bottom of the shielding shell 3.

Referring to FIGS. 1-5, in assembling of the electrical connector 100, one first contact module 21 and two second contact modules 22 are inserted into the housing 1 in sequence, with the first slot 214 and the second slots 224 aligned with the inserting opening 12. The housing 1 together with the contact modules 2 is mounted into the receiving cavity 32 of the shielding shell 3 through the mounting opening 33.

Figure 6:
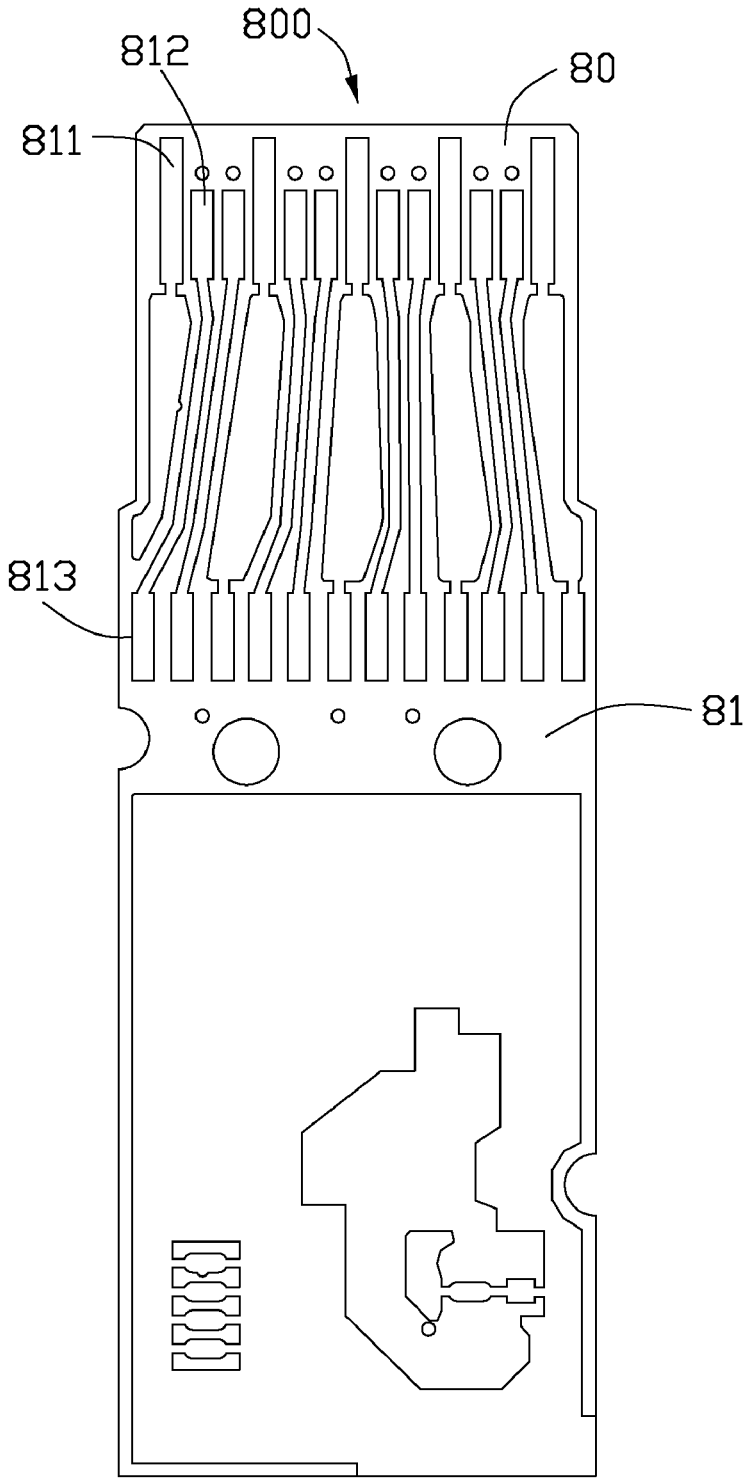
FIG. 6 is a perspective view showing a first face of the paddle board.
Figure 7:
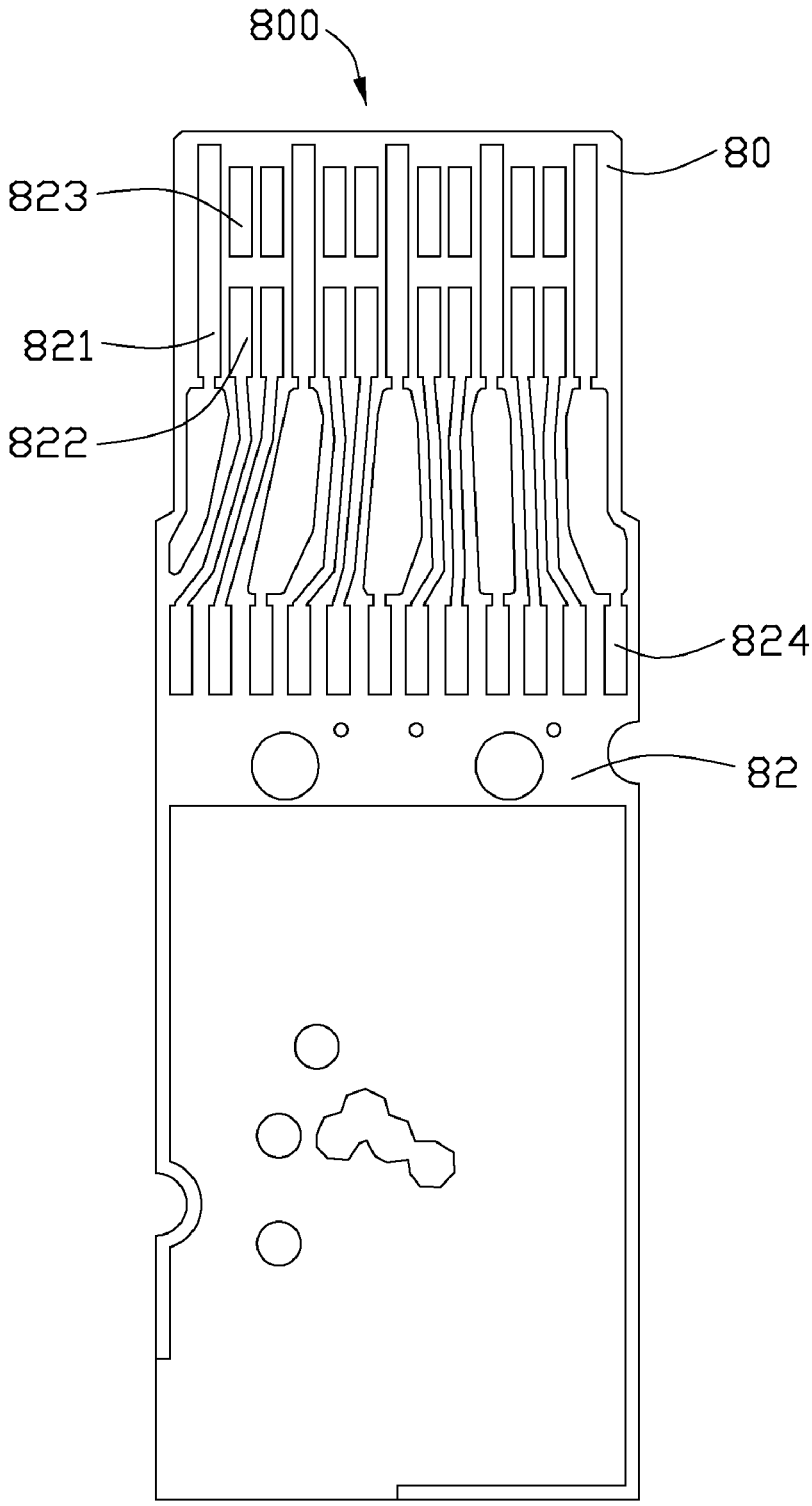
FIG. 7 is a perspective view showing a second face of the paddle board referenced in the first embodiment.

Referring to FIGS. 6 and 7, the paddle board 800 has a mating edge 80, a first face 81 and a second face 82 opposite to the first face 81. The first face 81 of the paddle board 800 includes five grounding pads 811 and four pairs of differential signal pads 812 arranged in one row adjacent to the mating edge 80, and a plurality of cable soldering pads 813 beyond the mating edge 80. Each grounding pad 811 has a length larger than that of the differential signal pads 812, and has a front end more adjacent to the mating edge 80.

The second face 82 of the paddle board 800 includes five grounding pads 821, four pairs of controlling pads 823 and four pairs of differential signal pads 822, and a plurality of cable soldering pads 824 beyond the mating edge 80. Each grounding pad 821 has a length larger than that of the controlling pad 823 or the differential signal pad 822, and has a front end more adjacent to the mating edge 80. The pairs of controlling pads 823 are disposed more adjacent to mating edge 80, compared to the pairs of differential signal pads 822. The controlling pads 823 could be formed into other low-frequency transmission pads.

The grounding pad 811 on the first face 81 and corresponding grounding pads 821 on the second face 82 are overlapped with each other. The differential signal pads 812 on the first face 81 and corresponding differential signal pads 822 on the second face 82 are partially overlapped with each other.

When the electrical connector 100 mates with the mating connector, the paddle board 800 is inserted into the receiving cavity 32 via the mating opening 31, and further inserted into the first slots 214 and the second slots 224 via the inserting opening 12.

Referring to FIGS. 4-7, the first upper contact portions 2111 of the first upper contacts 211 of the first contact modules 21 come to contact with the grounding pads 811 of the first face 81 of the paddle board 800 to transmit grounding signals. The first lower contact portions 2121 of the first lower contact terminals 212 come to contact with the grounding pads 821 of the second face 82 of the paddle board 800 for grounding. The pair of second upper contact portions 2211 of second upper terminals 22 of adjacent two second contact modules 22 come to contact with differential signal pads 812 of the first face 81 of the paddle board 800 for transmitting differential signals. The pair of second lower contact portions 2221 of two adjacent lower contact terminals 222 come to contact with differential signal pads 822 for transmitting differential signals. The pair of second lower contact portions 2231 of two adjacent lower conductive terminals 223 come to contact with two controlling pads 823 for transmitting controlling signal.

The first and second upper mounting portions 2112, 2212 extend along the mating direction for being surface mounted on the mother board 900 or extend downwardly for being press-fit mounted on the mother board 900. The first and second lower mounting portions 2122, 2222, 2232 extend along the mating direction for being surface mounted on the mother board 900 or extend downwardly for being press-fit mounted on the mother board 900.

The paddle board 800 is formed with more type and more number of conductive pads, to transmit more types of signals and establish grounding between two pairs of differential signals, without enlarging the dimension of the paddle board 800. The first upper terminals 211 and the first lower contact terminals 212 are insert molded with the first wafer 210 stably to establish electrical connection with the paddle board 800 reliably, so do the second contact modules 22.

Figure 9:
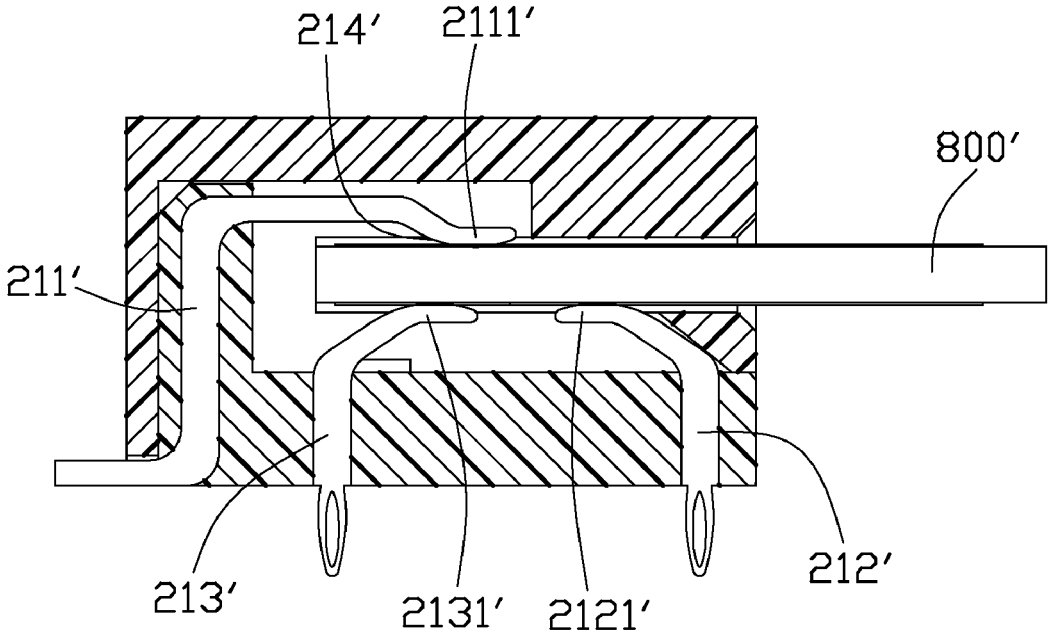
FIG. 9 is a cross-sectional view showing the first contact module in contact with a paddle board referred in the second embodiment, with the first wafer omitted.

In a second embodiment, the second contact module 22 is identical to that referred in the first embodiment. Referring to FIG. 9, the first contact module 21' in the second embodiment includes a first upper terminal 211' having a first upper contact portion 2111', a first lower contact terminal 212' having a first lower contact portion 2121', and a first lower conductive terminal 213' having a first lower conductive portion 2131'.

Figure 8:
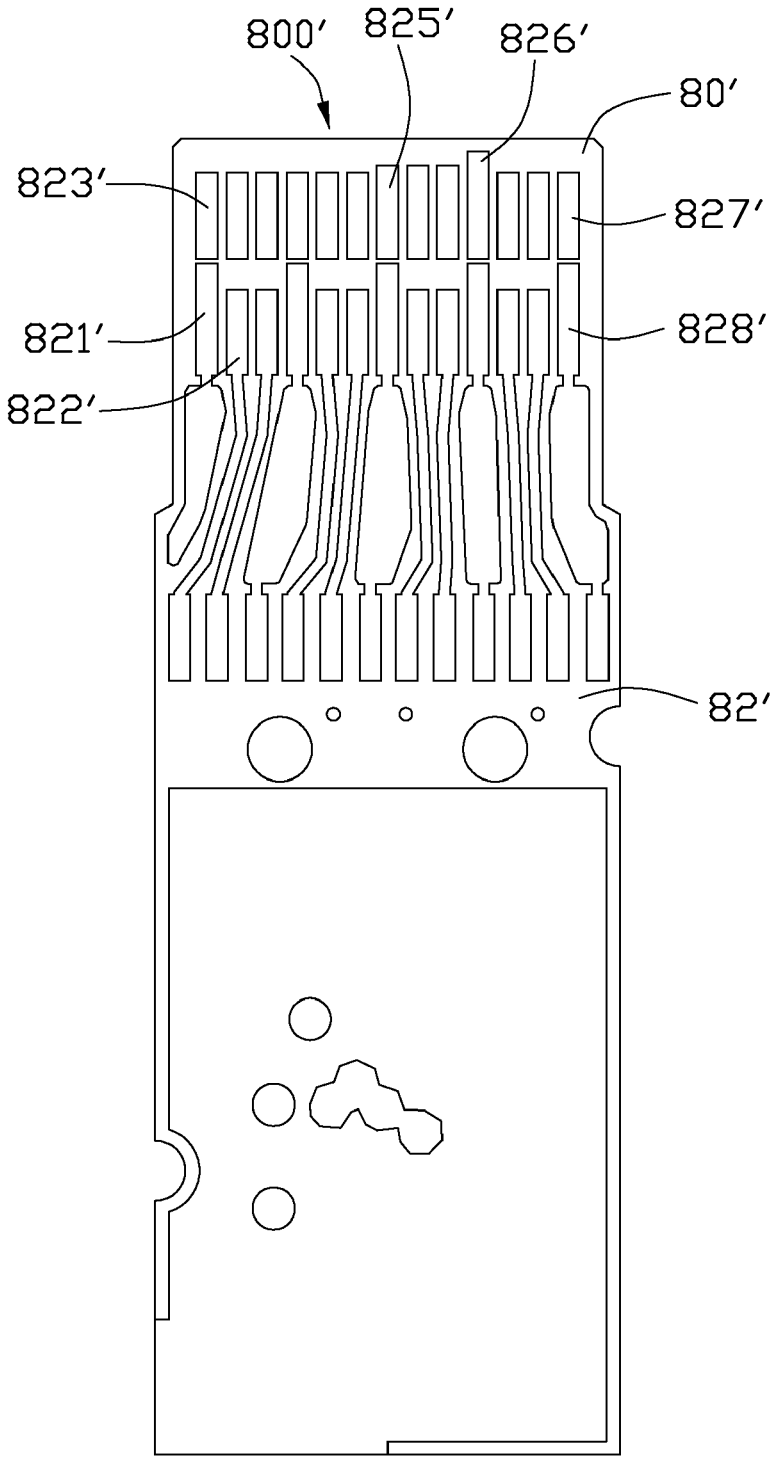
FIG. 8 is a perspective view showing the second face of the paddle board referred in a second embodiment.

The first face 81 of the paddle board 800' referred in the second embodiment is identical to that referred in the first embodiment shown in FIG. 6. Referring to FIG. 8, the second face 82' of the paddle board 800' is formed with a second row of conductive pads 828' and a third row of conductive pads 827'. The third row of conductive pads 827' are disposed more adjacent to the mating edge 80', compared to the second row of conductive pads 828'. The third row of conductive pads 827' include a plurality of controlling pads 823', power pads 825' and grounding pads 826'. The second row of conductive pads 828' include a plurality of grounding pads 821' and differential signal pads 822', with one pair of the differential signal pads 822' disposed between two grounding pads 821'.

When the paddle board 800' is inserted, the conductive pads of the first face 81 of the paddle board 800' come to contact with the first upper terminals 211' and the second upper terminals 221. The third row of conductive pads 827' of the second face 82' of the paddle board 800' come to contact with the first lower contact terminals 212' and the second lower contact terminals 222. The second row of conductive pads 828' of the second face 82' of the paddle board 800' come to contact with the first lower conductive terminals 213' and the second lower conductive terminals 223.

The grounding pads 821' of the second face 82' of the paddle board 800' in the second embodiment is designed into a shorter dimension than that of the grounding pads 821 in the first embodiment. The controlling pads 823' are formed more adjacent to the mating edge 80', compared to the grounding pads 821'. The first lower conductive terminals 213' come to contact with the controlling pads 823'. More number of differential signal pads and controlling pads could be formed in the paddle board 800'.

Figure 10:
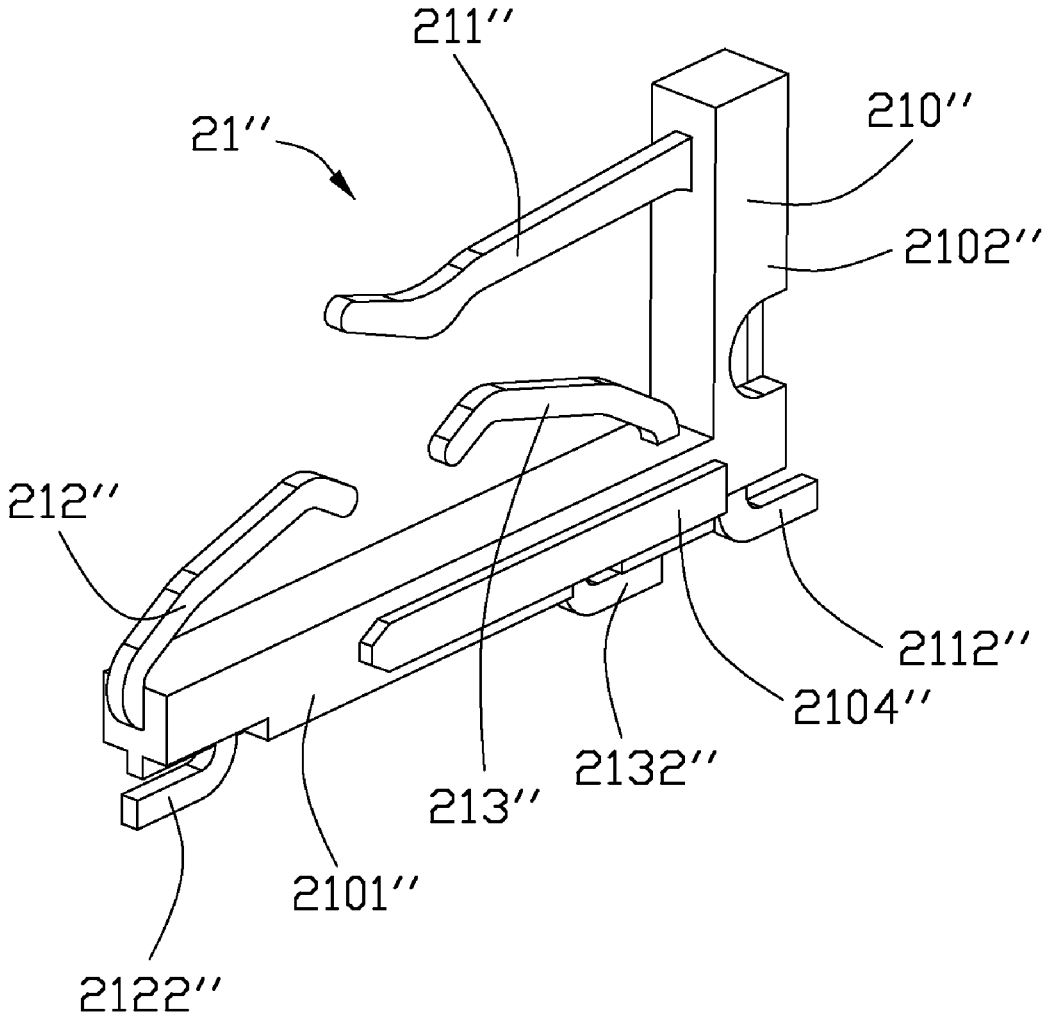
FIG. 10 is perspective view showing the first contact module referred in a third embodiment.
Figure 11:
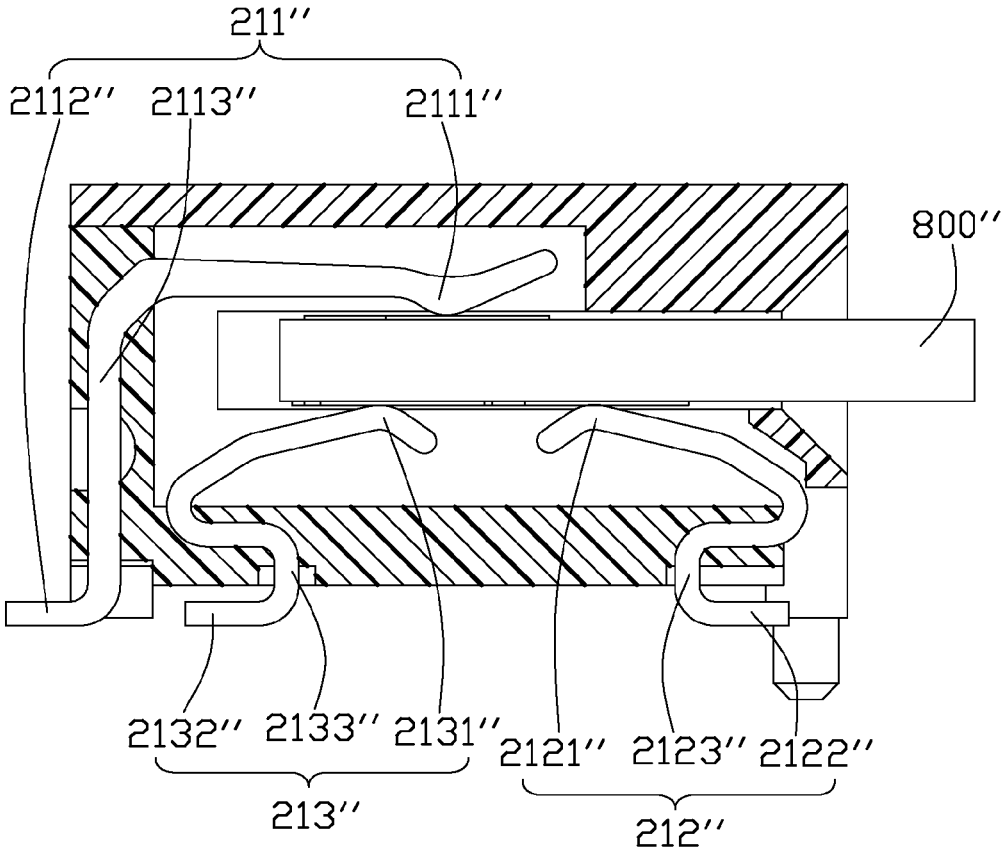
FIG. 11 is a cross-sectional view showing the first contact module in contact with a paddle board referred in the third embodiment, with the first wafer omitted.

Referring to FIGS. 10-11, in a third embodiment, the first contact module 21" includes a first wafer 210", a first upper terminal 211", a first lower contact terminal 212" and a first lower conductive terminal 213" insert molded in the first wafer 210". The first wafer 210" comprises a base portion 2101" and a supporting portion 2102" extending from the base portion 2101". The base portion 2101" of the first wafer 210" is formed with a guiding portion 2104" at a side face for guiding purpose. The guiding portion 2104" could be applied in the first embodiment and the second embodiment.

The first upper terminal 211" includes a first upper contact portion 2111", a first upper mounting portion 2112", a first upper connecting portion 2113" connecting with the first upper contact portion 2111" and the first upper mounting portion 2112". The first lower contact terminal 212" includes a first lower contact portion 2121", a first lower mounting portion 2122", a first lower connecting portion 2123" connecting with the first lower contact portion 2121" and the first lower mounting portion 2122". The first lower conductive terminal 213" includes a first lower contact portion 2131", a first lower mounting portion 2132", a first lower connecting portion 2133" connecting with the first lower contact portion 2131" and the first lower mounting portion 2132".

The first lower contact portion 2121" of the first lower contact terminal 212" and the first lower contact portion 2131" of the first lower conductive terminal 213" are formed into upwardly projecting arch-like shape. The first lower connecting portion 2123" of the first lower contact terminal 212" and the first connecting portion 2133" of the first lower conductive terminal 213" are formed into S-shape. The first lower mounting portion 2122" of the first lower contact terminal 212" and the first lower mounting portion 2132" of the first lower conductive terminal 213" extend toward opposite directions for being surface mounted on the mother board 900. The second contact module (not shown) has a configuration same to that of the first contact module 21". The configuration of first contact module 21" could be applied in the first or second embodiments.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector adapted for being mounted on a mother board, comprising:

a housing; and a plurality of contact modules secured to the housing, each contact module comprising:

a wafer; and a plurality of terminals insert molded with the wafer, said terminals including an upper terminal having an upper contact portion and a lower contact terminal having a lower contact portion, said upper contact portion and the lower contact portion being separated from each other along a vertical direction to define a slot therebetween, said upper terminal and said lower contact terminal being secured in the wafer at two secured positions remote from each other along a mating direction perpendicular to the vertical direction, with the upper contact portion and the lower contact portion approaching close to each other along the mating direction; said upper terminal comprises an upper mounting portion and an upper connecting portion connecting with the upper contact portion and the upper mounting portion, and said lower contact terminal comprises a lower mounting portion and a lower connecting portion connecting with the lower contact portion and the lower mounting portion, and wherein said wafer comprises a base portion extending along the mating direction and a supporting portion extending along the vertical direction from one end of the base portion, said upper connecting portion of the upper terminal secured in the supporting portion along the mating direction, said lower connecting portion of the lower contact terminal secured in the base portion along the vertical direction.

2. The electrical connector as claimed in claim 1, wherein said upper mounting portion of the upper terminal extends along the mating direction for being surface mounted on the mother board; and said lower mounting portion of the lower contact terminal extends downwardly for being press-fit mounted on the mother board.

3. The electrical connector as claimed in claim 1, wherein said upper contact portion of the upper terminal and the lower contact portion of the lower contact terminal are separated from each other a first distance along the mating direction and a second distance along the vertical direction.

4. The electrical connector as claimed in claim 1, wherein said base portion of the wafer has a stepped portion below the slot and facing to the upper contact portion of the upper terminal, the lower contact portion of the lower contact terminal having an upper surface substantially flush with the stepped portion.

5. The electrical connector as claimed in claim 1, wherein said base portion of the wafer is formed with a guiding portion at a side face.

6. The electrical connector as claimed in claim 1, wherein said contact module comprises a lower conductive terminal arranged in mirrored image with the lower contact terminal.

7. The electrical connector as claimed in claim 6, wherein said lower conductive terminal has a lower contact portion, a lower mounting portion, and a lower connecting portion connecting with the lower contact portion and the lower mounting portion and secured in the wafer at a secured position between the secured position of the upper terminal and the secured position of the lower contact terminal.

8. The electrical connector as claimed in claim 7, wherein said upper contact portion of the upper terminal extends forwardly and is disposed above the slot, and the lower contact portion of the lower conductive terminal extends forwardly and is disposed below the slot, the lower contact portion of the lower contact terminal having an upper surface substantially flush with that of the lower contact portion of the lower conductive terminal.

9. The electrical connector as claimed in claim 7, wherein said lower connecting portion of the lower contact terminal and the lower connecting portion of the lower conductive terminal are respectively formed into S-shape, the lower mounting portion of the lower contact terminal and the lower mounting portion of the lower conductive terminal extending toward opposite directions for being surface mounted on the mother board.

10. An electrical connector for use within a metallic cage, comprising:

an insulative housing defining a front wall with a receiving cavity behind the front wall in a front-to-back direction and with a bottom opening downwardly communicating the receiving cavity with an exterior in a vertical direction perpendicular to said front-to-back direction;

a board receiving opening formed in the front wall of the housing to communicate with the receiving cavity with the exterior in the front-to-back direction; and a plurality of wafers stacked with one another along a transverse direction perpendicular to both said front-to-back direction and said vertical direction, and commonly received in said receiving cavity under condition that said assembled wafers are assembled upwardly into the receiving cavity through the bottom opening; wherein each of said wafers is integrally equipped with an upper terminal and a lower terminal to commonly define a board receiving slot therebetween in alignment with the board receiving opening for allowing a mating board to be inserted rearwardly thereinto via said board receiving opening.

11. The electrical connector as claimed in claim 10, wherein said upper terminal and said lower terminal are offset from each other in the front-to-back direction.

12. The electrical connector as claimed in claim 11, wherein the lower terminal is located in front of the upper terminal.

13. The electrical connector as claimed in claim 12, wherein each of said wafers is further equipped with another lower terminal which is located in front of the corresponding lower terminal in the front-to-back direction, and essentially aligned with and under the corresponding upper terminal.

14. The electrical connector as claimed in claim 10, wherein the front wall defines a recess in a lower end to receive a front end of each of the wafers so as to restrain upward movement of the wafer.

15. The electrical connector as claimed in claim 10, wherein the upper terminal defines a surface mount type tail while the lower terminal defines a through hole type tail.

16. An electrical connector for use within a metallic cage and with a board, comprising:

a plurality of first and second wafers alternately arranged and stacked with one another along a transverse direction;

each of said first wafers is integrally equipped with a first upper terminal and a first lower terminal to commonly define a board receiving slot therebetween in a vertical direction perpendicular to said transverse direction under condition that the first upper terminal and the first lower terminal are offset from each other in a front-to-back direction perpendicular to both said transverse direction and said vertical direction; and each of said second wafers is integrally equipped with a second upper terminal and a pair of second lower terminals to commonly define said board receiving slot between therebetween in the vertical direction; wherein said pair of lower terminals are offset from each other in the front-to-back direction with one of said pair of second lower terminals is aligned with and under the corresponding second upper terminal in the vertical direction while the other of said pair of second lower terminals is aligned with the first lower terminal in said transverse direction.

17. The electrical connector as claimed in claim 16, wherein the upper terminal defines a surface mount type tail while the pair of lower terminals define through hole type tails.

18. The electrical connector as claimed in claim 16, further including an insulative housing defining a receiving cavity therein, wherein the wafers are upwardly assembled into the receiving cavity via a bottom opening of the housing.

* * * * *